US005218746A

United States Patent [19]

Yamanishi

[11] Patent Number: 5,218,746

[45] Date of Patent: Jun. 15, 1993

[54] BUCKLE OF A SEAT BELT DEVICE

[75] Inventor: Takahiro Yamanishi, Shiga, Japan

[73] Assignee: Takata Corporation, Tokyo, Japan

[21] Appl. No.: 912,190

[22] Filed: Jul. 13, 1992

[30] Foreign Application Priority Data

Jul. 19, 1991 [JP] Japan ..... 3-179369

[51] Int. Cl.[5] ..... A44B 11/25

[52] U.S. Cl. ..... 24/603; 24/633; 24/637

[58] Field of Search ..... 24/603, 633, 636, 637; 297/468, 483

[56] References Cited

U.S. PATENT DOCUMENTS 5,067,211 11/1991 van Riesen ..... 24/633 X

*Primary Examiner*—James R. Brittain

*Attorney, Agent, or Firm*—Kanesaka and Takeuchi

[57] ABSTRACT

A buckle of a seat belt device, for securing a tongue of the seat belt device, comprises: an insertion path into which the tongue is inserted; and a latch unit, provided in the insertion path, for hindering a removal of the tongue. An engaging device which engages with the tongue is provided in the insertion path. Provided also is a drive unit for moving the engaging device in a tongue inserting direction.

8 Claims, 6 Drawing Sheets

BUCKLE OF A SEAT BELT DEVICE

BACKGROUND OF THE INVENTION

1. Field of the Invention

The present invention relates generally to a buckle of a seat belt device, provided in a vehicle, for protecting an occupant and, more particularly, to a buckle of a seat belt device incorporating a mechanism for drawing a tongue.

2. Related Background Art

A seat belt device is constructed such that a tongue is inserted into a buckle provided aside of a seat of the vehicle, and an occupant is restrained by a seat belt by latching with a latch unit.

In the conventional seat belt device, it is required that the occupant catches the tongue with a hand and intrudes it deeply into the buckle. For performing this operation, however, the occupant effects the insertion into the buckle while the upper half of the body twists sideways. This results in such a problem that the upper half of the body stiffens, and the operability declines.

SUMMARY OF THE INVENTION

It is a primary object of the present invention to provide a buckle of a seat belt device which is capable of moving a tongue in a draw-in direction of a buckle, facilitating an insertion of the tongue into the buckle, eliminating the necessity that an occupant in the vehicle has to intrude the tongue into the buckle while the upper half of the body twists and making it possible to easily use the seat belt device.

It is another object of the present invention to provide a buckle of a seat belt device in which the tongue is smoothly drawn into the buckle with the aid of belts.

It is still another object of the present invention to provide a buckle of a seat belt device in which the tongue is extremely smoothly drawn into the buckle because of the tongue being sandwiched in between the belts.

It is a further object of the present invention to provide a buckle of a seat belt device in which the tongue is automatically drawn into the buckle when inserting the tip of the tongue into a insertion port of the buckle, and hence the tongue can be set therein more easily.

It is a still further object of the present invention to provide a buckle of a seat belt device in which the tongue can be pulled out of the buckle by reversing the rotation of a motor, and a tongue removing operation can be performed by manipulating a switch.

It is yet another object of the present invention to provide a buckle of a seat belt device in which a latch is automatically released when rotating the motor in the reverse direction, and the tongue can be therefore removed more easily.

A buckle of a seat belt device according to a first mode, for securing a tongue of the seat belt device, comprises: an insertion path into which the tongue is inserted; and a latch unit, provided in the insertion path, for hindering a removal of the tongue. This buckle further includes an engaging means provided in the insertion path and engaging with the tongue and a drive unit for moving the engaging means in a tongue inserting direction.

In the buckle of the seat belt device according to the first mode, a buckle of a seat belt device according to a second mode is arranged such that the engaging means is constructed of endless belts rotatable along the insertion path, and the drive unit is a motor for rotating the belts.

In the buckle of the seat belt device according to the second mode, a buckle of a seat belt device according to a third mode is arranged such that the belts are so disposed as to be paired, with the insertion path interposed therebetween, and are synchronously driven by the motor.

In the buckle of the seat belt device according to the second or third mode, a buckle of a seat belt device according to a fourth mode is arranged such that sensors for detecting the tongue are provided respectively at an inlet of the insertion path and in an inner part thereof, the motor rotates the belts in the tongue inserting direction when the sensor at the inlet detects the tongue. and the motor is stopped when the sensor in the inner part detects the tongue.

In the buckle of the seat belt device according to the fourth mode, a buckle of a seat belt device according to a fifth mode further comprises a means for reversing the rotation of the motor to rotate the belts in the tongue removing direction, the motor being stopped when the sensor at the inlet does not detect the tongue.

In the buckle of the seat device according to the fifth mode, a buckle of a seat belt device according to a sixth mode further comprises a latch release mechanism for releasing the latch of a latch unit when the motor is rotated in the reverse direction.

In the buckle of the seat belt device according to the present invention, when inserting the tip of the tongue into the tongue receiving port of the buckle, the tongue engages with the engaging means. This engaging means is moved in an inner direction by the drive unit, whereby the tongue is pulled into the buckle and latched by the latch unit. Hence, the tongue is insertable into the buckle without being intruded deeply into the buckle by the occupant.

In the buckle of the seat belt device according to the present invention, the belts are endlessly rotated, whereby the tongue is pulled by the belts and drawn into the buckle.

In the buckle of the seat belt device according to the present invention, the belts are so disposed as to be paired. The tongue is pulled while being sandwiched in between the belts and drawn into the buckle.

In the buckle of the seat belt device according to the present invention, when inserting the tip of the tongue into the inlet of the buckle, the belts are rotated, and the tip of the tongue is thereby drawn into the buckle. Then, when the tip of the tongue is inserted deeply into the buckle, the motor is stopped.

In the buckle of the seat belt device according to the present invention, it is possible to pull the tongue out of the buckle by rotating the motor in the opposite direction.

In the buckle of the seat belt device according to the present invention, when reversing the rotation of the motor, the latch is released, and the tongue is automatically pulled out of the buckle.

BRIEF DESCRIPTION OF THE DRAWINGS

Other objects and advantages of the present invention will become apparent during the following discussion taken in conjunction with the accompanying drawings, in which.

Figure 1:
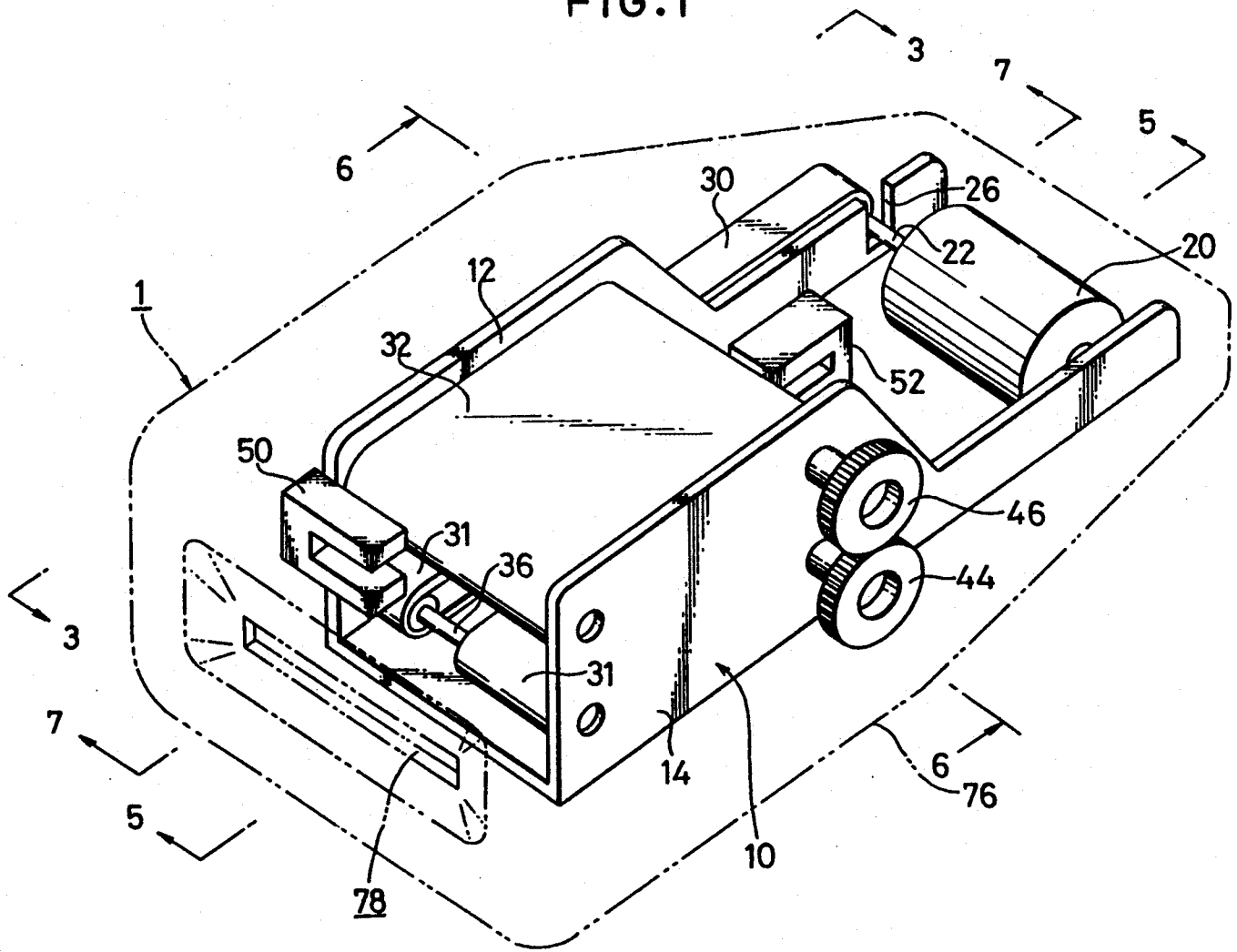
FIG. 1 is a perspective view illustrating an interior of a buckle in an embodiment of the present invention.
Figure 2:
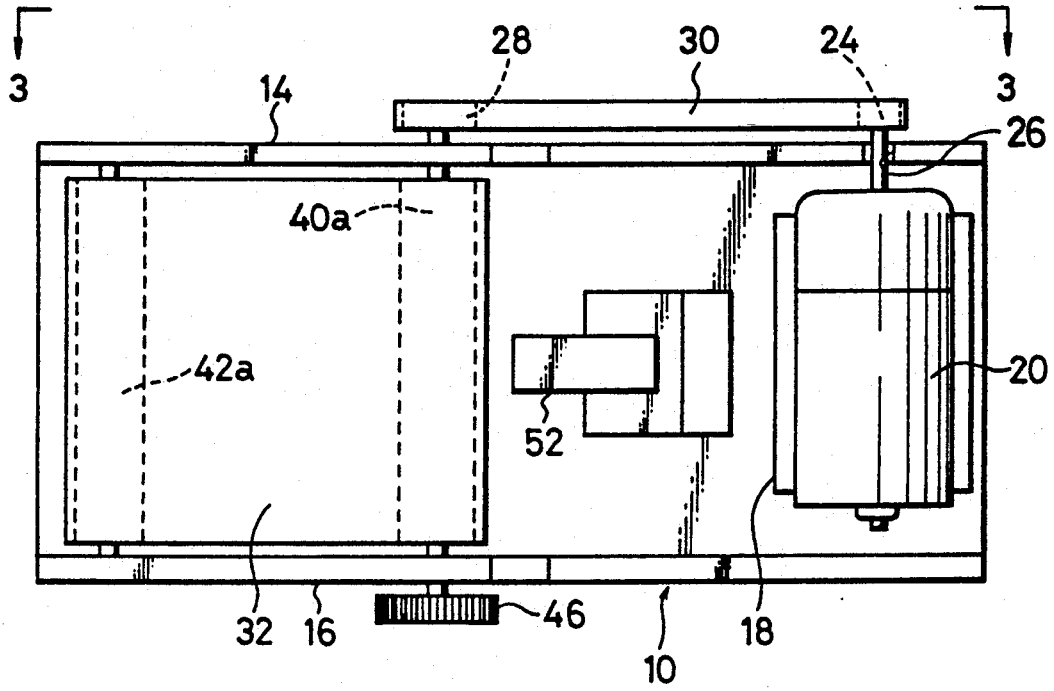
FIG. 2 is a plan view depicting an internal mechanism of a buckle.
Figure 3:
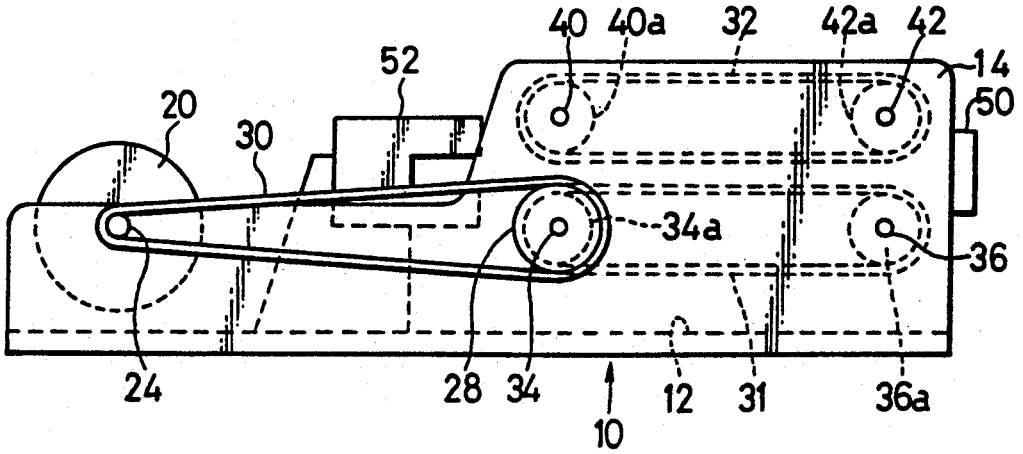
FIG. 3 is a side elevation view illustrating the internal mechanism of the buckle.

DESCRIPTION OF THE PREFERRED EMBODIMENTS:

A buckle 1 of a seat belt device in an embodiment of the present invention will hereinafter be described with reference to the drawings.

To start with, an internal mechanism of the buckle 1 will be explained. A base generally indicated at 10 includes a main plate 12 and a pair of side plates 14, 16 erected from both sides of the main plate 12. A motor 20 is mounted at one end of the base 10 through a motor mounting seat 18. A pulley 24 is fixed to a tip of a rotor shaft 22. The rotor shaft 22 of the motor 20 is inserted into a notched portion 26 of the side plate 14, and the pulley 24 is disposed outwardly of the side plate 14.

A pulley 28 is disposed outwardly of the side plate 14 at a substantially central part of the base 10. A drive belt 30 is stretched between the pulleys 24, 28.

First and second belts 31, 32 for drawing a tongue 33 are provided between the side plates 14, 16. The first belt 31 is stretched between a pair of shafts 34, 36 inserted respectively into shaft support holes 38 of the side plate 14, 16. One end of the shaft 34 extrudes outwards from the side plate 14, and the pulley 28 is fixed to this extruded end. These first and second belts 31, 32 have their belt running surfaces parallel to the main plate 12 of the base 10. Further, a gap is formed between the two belts 31, 32 enough to have the tongue 33 sandwiched in therebetween.

Note that the second belt 32 is stretched between shafts 40, 42 to which pulleys 40*a*, 42*a* are fixed. Besides, pulleys 34*a*, 36*a* are similarly fixed to the shafts 34, 36.

Top ends of the respective shafts 34, 40 protrude outwards from the shaft support holes 38 of the side plate 16, and gears 44, 46 are fixed to these tips. The gears 44, 46 meshing with each other can be rotatably driven in directions opposite to each other in synchronization with the shafts 34, 40.

As described above, the gap (space) enough to have the tongue 33 sandwiched is formed between the belt running surface of the first and second belts 31, 32. The space between these belts 31, 32 serves as a tongue inserting path 48. A front sensor 50 is provided on the side of an inlet of this tongue inserting path 48, i.e., on the side of the tip of the base 10. On the other hand, a rear sensor 52 is provided on the side of the rear end of the inserting path 48. These sensors 50, 52 for detecting the tongue 33 are composed of, e.g., light emitting elements and light receiving elements.

The first belt 31 is smaller in width than the second belt 32, and these belts are so disposed on both ends of the shafts 34, 36 as to be paired. Then, a latch 54 is interposed between the belts 31, 31. The latch 54 has a pawl 56 formed at its tip and a boss 58 integrally formed at its rear end. Shafts 60 project respectively from the both edge surfaces of the boss 58. These shafts 60 are inserted into shaft support holes 61 of the side plates 14, 16.

Figure 4:
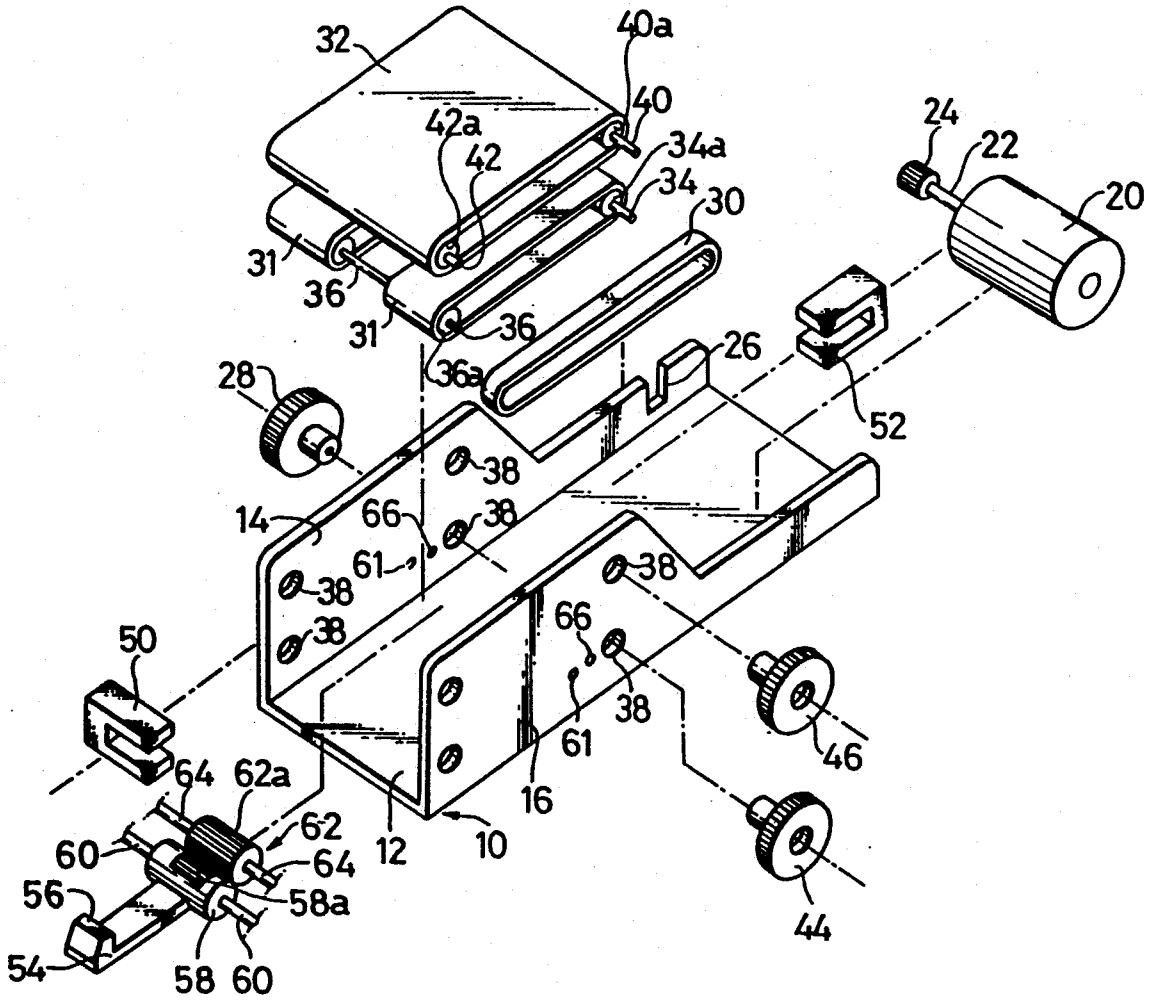
FIG. 4 is an exploded perspective view showing the internal mechanism of the buckle.
Figure 5:
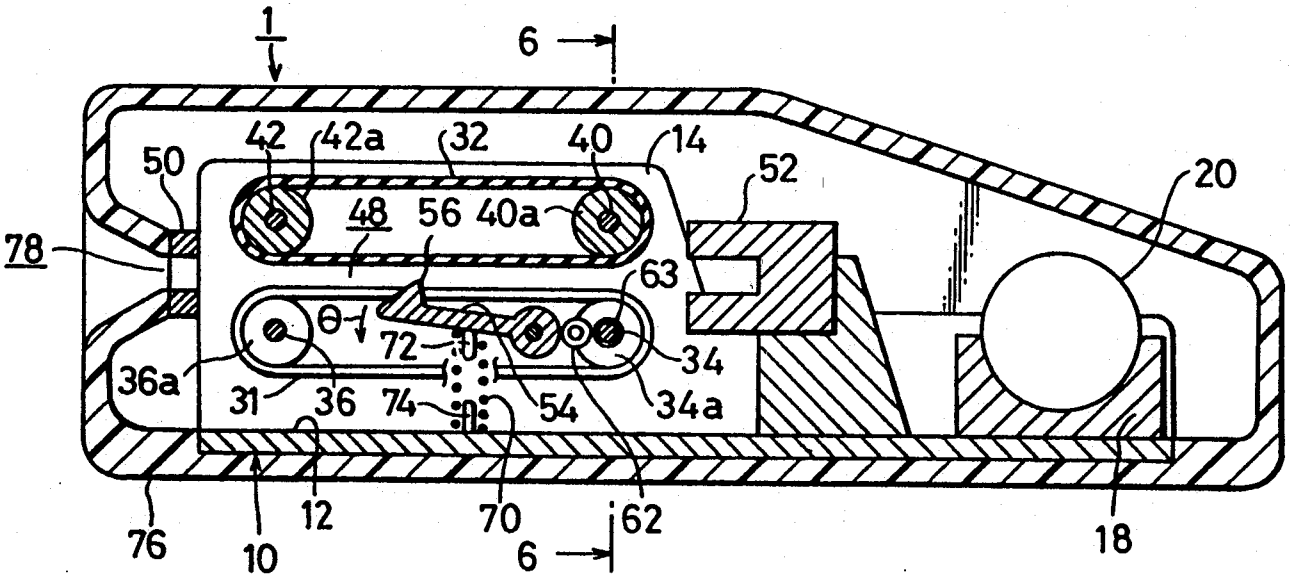
FIG. 5 is a vertical sectional view of the buckle.

Teeth 58*a* are cut in an outer peripheral surface of the boss 58. As illustrated in FIGS. 4 and 5, a one-way clutch 62 formed with gear teeth 62*a* engaging with the teeth 58*a* is interposed between the latch 54 and a gear 63 of the shaft 34. Shafts 64 provided on the one-way clutch 62 are inserted into shaft support holes 66 formed in the side plates 14, 16.

As depicted in FIG. 5, this latch 54 is biased by a spring 70 in such a direction that the pawl 56 advances in the inserting path 48. This spring 70 is interposed between the latch 54 and the main plate 12 of the base 10. The spring 70 is secured respectively to a projection 72 on the side of the latch 54 and a projection 74 on the side of the main plate 12.

Figure 6:
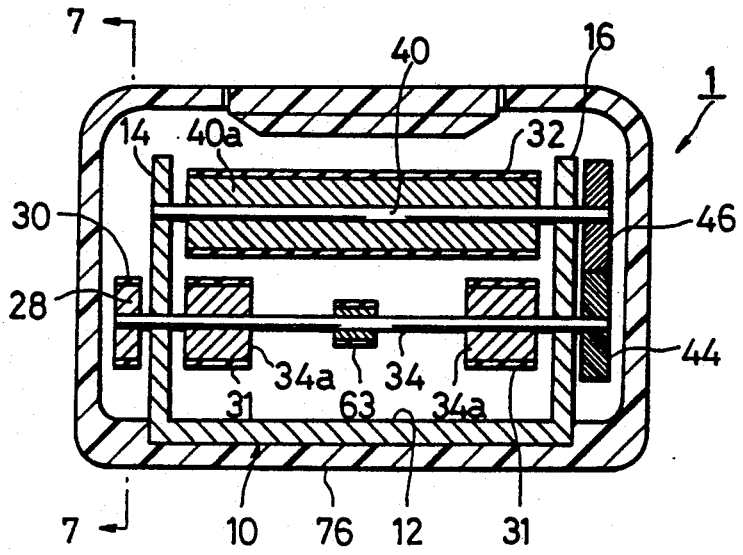
FIG. 6 is a sectional view taken substantially along the line 6—6 of FIG. 5.
Figure 7:
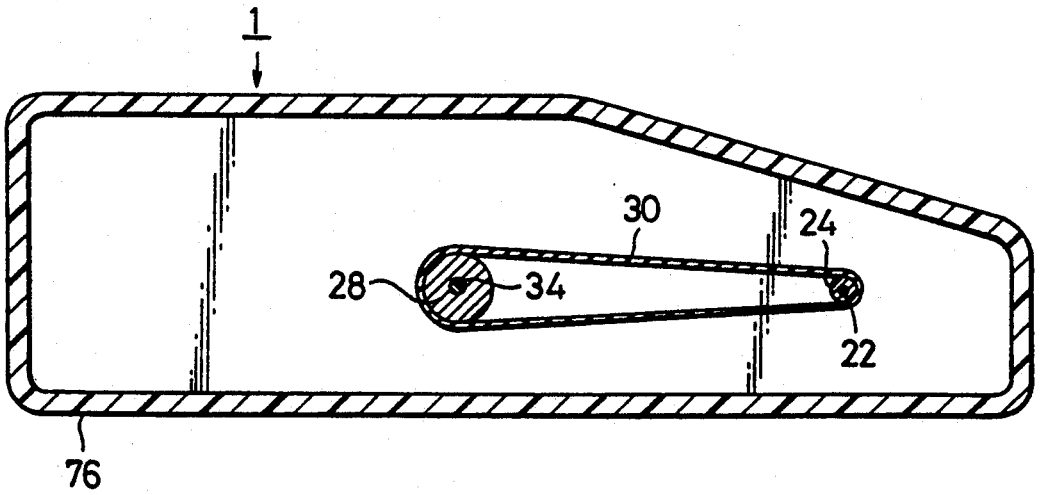
FIG. 7 is a sectional view taken substantially along the line 7—7 of FIG. 6.

A cover 76 is, as illustrated in FIGS. 5–7, provided to incorporate such an internal mechanism. The numeral 78 represents an insertion port of the tongue 33.

Figure 8:
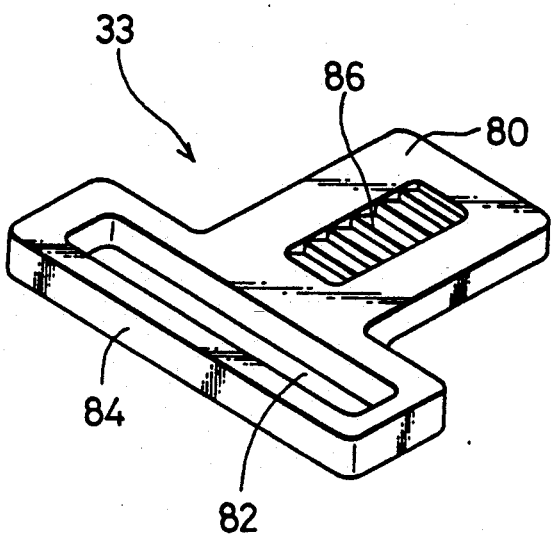
FIG. 8 is a perspective view illustrating a tongue.

As illustrated in FIG. 8, the tongue 33 is composed of an insertion part 80 into the buckle 10 and a proximal part 84 formed with a belt lap hole 82. The insertion part 80 is a flat plate in this embodiment, and serrate portions 86 are formed on both surfaces thereof. A seat belt 88 is, as illustrated in FIG. 9, inserted into this belt lap hole 82.

Figure 9:
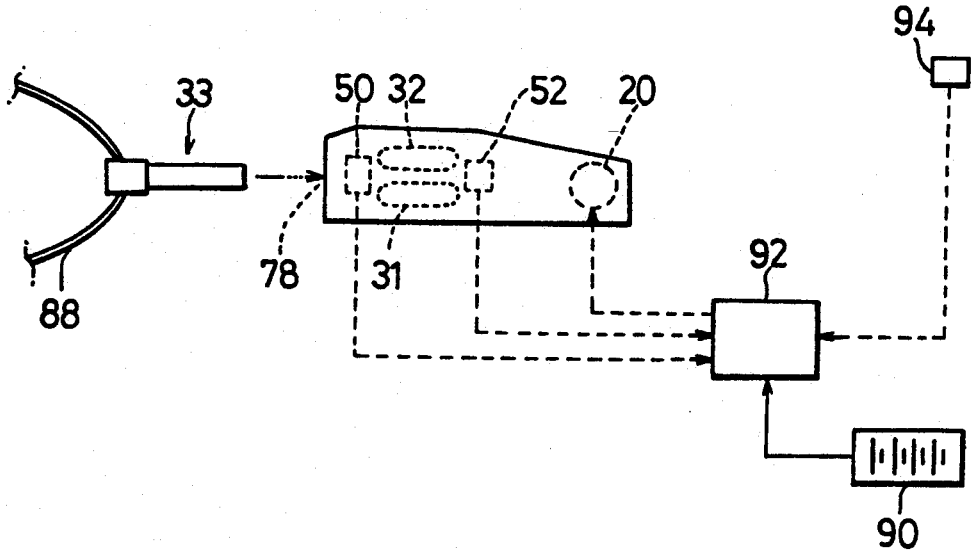
FIG. 9 is a view showing a control system of the tongue.

FIG. 9 is a view showing a control system of the buckle 10. A controller 92 is supplied with electricity from a battery 90 of the vehicle. A motor 20 is rotated in forward and reverse directions by electric power given from the controller 92. Detection signals of the front sensor 50 and the rear sensor 52 are inputted to the controller 92. Note that a signal of a tongue removing switch 94 for reversing the rotations of the motor 20 is also inputted to the controller 92. This tongue removing switch 94 is provided on, e.g., an instrument panel of the vehicle.

In the buckle of the thus constructed seat belt device, when inserting the insertion part 80 of the tongue 33 into the insertion port 78, the front sensor 50 detects the tongue 33. The motor 20 is thereby rotated in response to the signal from the controller 92. Then, the first belt 31 is rotationally driven in the tongue draw-in direction through the pulley 24 and the drive belt 30. Simultaneously, the second belt 32 is also rotationally driven in the draw-in direction of the tongue through the gears 44, 46. The tip of the tongue 33 is thereby sandwiched in between the belts 31, 32 and drawn in the interior of the buckle 10. Then, the insertion part 80 is inserted deeply in the insertion path 48. When the tip of the insertion part 80 reaches the rear sensor 52, the rear sensor 52 detects the tongue 33. The motor 20 stops in response to a detection signal thereof. Note that when the insertion part 80 of the tongue 33 is inserted sufficiently deeply into the insertion path 48, the pawl 56 of the latch 54 engages with the serrate portion 86 of the tongue 33, resulting in a latched state where the tongue 33 can not be removed from the buckle 10 even by pulling the tongue 33.

When operating the tongue removing switch 94, the motor 20 is driven in the reverse direction. Then, the first and second belts 31, 32 are rotated in the tongue removing direction. In addition, the latch 54 is concurrently rotated downwards in FIG. 5. Namely, the motor 20 is rotated in the reverse direction. When the shaft 34 is concomitantly rotated in the reverse direction, the latch 54 is biased in an arrowed direction $\theta$ of FIG. 5 through the one-way clutch 62, whereby the pawl 56 is separated from the serrate portion 86. The tongue 33 is thus removed from the buckle 10.

Although the illustrative embodiment of the present invention has been described in detail with reference to the accompanying drawings, it is to be understood that the present invention is not limited to this embodiment. Various changes or modifications may be effected by one skilled in the art without departing from the scope or spirit of the invention.

What is claimed is:

1. A buckle of a seat belt device, for securing a tongue of said seat belt device, comprising:

an insertion path into which said tongue is inserted;

a latch unit, provided in said insertion path, for hindering a removal of said tongue;

engaging means engaging with said tongue provided in said insertion path, said engaging means being formed of endless belts rotatable along said insertion path; and a drive unit for moving said engaging means in a tongue inserting direction, said drive unit being a motor for rotating said belts.

2. The buckle of the seat belt device as set forth in claim 1, wherein said belts are so disposed as to be paried, with said insertion path interposed therebetween, and are synchronously driven by said motor.

3. The buckle of the seat belt device as set forth in claim 1, wherein sensors for detecting said tongue are provided respectively at an inlet of said insertion path and in an inner part thereof, said motor rotates said belts in the tongue inserting direction when said sensor at the inlet detects said tongue, and said motor is stopped when said sensor in the inner part detects said tongue.

4. The buckle of the seat belt device as set forth in claim 3, further comprising means for reversing the rotation of said motor to rotate said belts in the tongue removing direction, said motor being stopped when said sensor at in the inlet does not detect said tongue.

5. The buckle of the seat belt device as set forth in claim 4, further comprising a latch release mechanism for releasing a latch of said latch unit when said motor is rotated in the reverse direction.

6. The buckle of the seat belt device as set forth in claim 5, wherein said latch releasing mechanism is a one-way clutch for transferring power of said motor to said tongue only when said motor rotates in the tongue ejecting direction.

7. A buckle of a seat belt device, for securing a tongue of said seat belt device, comprising:

an insertion path for inserting said tongue;

a latch unit provided in said insertion path for hindering a removal of said tongue;

engaging means engaging said tongue, said engaging means being formed in said insertion path and transferring the tongue along the insertion path; and a drive unit for actuating said engaging means, said drive unit, when the tongue is placed at an inlet of the insertion path, operating the engaging means to automatically move the tongue along the insertion path in a tongue insertion direction to engage with the latch unit.

8. The buckle of the seat belt device as set forth in claim 7, further comprising means for reversing operation of the drive unit, said engaging means, when the reversing means is actuated, automatically moving the tongue along the insertion path in a tongue removing direction while disengaging the tongue from the latch unit.

* * * * *